United States Patent [19]

Boyd et al.

[11] 3,976,521

[45] Aug. 24, 1976

[54] METHOD OF COATING BORON PARTICLES WITH AMMONIUM PERCHLORATE

[75] Inventors: Durrell D. Boyd, Annandale; Lewis B. Childs, Springfield, both of Va.

[73] Assignee: The United States of America as represented by the Secretary of the Air Force, Washington, D.C.

[22] Filed: Nov. 20, 1974

[21] Appl. No.: 525,337

[52] U.S. Cl. ..... 149/5; 149/22; 149/76; 427/216

[51] Int. Cl.[2] ..... C06B 21/00

[58] Field of Search ..... 149/5, 76, 22; 427/216

[56] References Cited

UNITED STATES PATENTS

| | | | |
|---|---|---|---|
| 2,190,703 | 2/1940 | Davis | 149/76 X |
| 3,539,377 | 11/1970 | Steinle | 149/76 X |
| 3,646,174 | 2/1972 | Macri | 149/76 X |
| 3,706,608 | 12/1972 | Geisler | 149/5 X |
| 3,728,086 | 4/1973 | Adicoff | 149/76 X |
| 3,830,673 | 8/1974 | Fletcher | 149/76 X |

*Primary Examiner*—Edward A. Miller

*Attorney, Agent, or Firm*—Joseph E. Rusz; William J. O'Brien

[57] ABSTRACT

A method for coating boron particles with ammonium perchlorate. The method involves the steps of dissolving ammonium perchlorate in liquid ammonia, adding a volatile non-solvent diluent and boron particles to the ammonia and then vaporizing the ammonia and diluent to form a coated product.

2 Claims, No Drawings

METHOD OF COATING BORON PARTICLES WITH AMMONIUM PERCHLORATE

BACKGROUND OF THE INVENTION

This invention relates to solid propellants useful for rocket propulsion. More specifically, this invention concerns itself with a method for coating finely divided boron fuel particles with an ammonium perchlorate oxidizer and to the coated particles produced thereby which find particular application in composite solid propellants.

Propellant compositions find application as a means for imparting motion to an object, such as a rocket or guided missile. Two main classes of propellants are recognized on the basis of their physical characteristic and are referred to as either liquid or solid propellants. Solid propellants are further divided into two separate groups. The first group is referred to as homogeneous solid propellants while the second group, which the present invention concerns itself with, is referred to as composite solid propellants.

Conventional composite solid propellants generally are mixtures of a finely ground oxidizer and a binder of plastic, resinous or elastomeric material. The matrix material provides fuel for the combustion while the oxidizer, being a major constituent, contributes most to the burning characteristics of the propellant. The burning rate, stability to detonation, flame temperature, and other burning characteristics depend to a great extent on the particular oxidizer and its particle size. Formulations containing ammonium perchlorate, a well known oxidizer, have somewhat lower burning rates and flame temperatures, with little smoke production.

In an attempt to improve the burning characteristics of propellants employing an ammonium perchlorate oxidizer, it has been suggested that finely divided metal powders, such as Al, Mg or B, be added to the propellant mix as an additional fuel component. The metal particles are preferably about 0.25 to 50 microns in size. The amount of metal powder is not critical, but is determined by the specific use and characteristics of the propellant composite. Amounts of only one or two percent have provided some improvement. Generally, the metal constitutes a major proportion by weight of the propellant with maximum amounts being determined by the need to avoid granulation of the mixture and a deficiency in the amount of oxidizer. The use of the metal powders tends to increase the density and improve the specific inputs of the propellant because of the metal powders high heat of combustion.

However, with certain applications, such as inflight controllability of the burning rate of the propellant, the use of separate metal fuel and oxidizer components has proven to be undesirable. In an attempt to overcome the problem, it was found that boron particles coated with ammonium perchlorate provided improved burning characteristics for propellant compositions using these ingredients. The reduced total surface area of the coated boron particles, as compared with the use of separate particles of boron and ammonium perchlorate, reduced the total surface area of the solids incorporated into the propellant. This made possible increased solids loading and improved the processability of the propellant. Combining the metal and oxidizer ingredient also raised the pressure exponent of the propellant as compared with the use of separate components which improves the inflight controllability of the propellants burning rate.

SUMMARY OF THE INVENTION

In accordance with this invention, it has been discovered that the burning characteristics of composite propellant compositions that utilize boron as a metallic fuel constituent and ammonium perchlorate as an oxidizing constituent can be materially improved if the boron particles are coated with the ammonium perchlorate oxidizer. The process for making the coated boron involves the steps of dissolving the ammonium perchlorate in ammonia, adding a diluent and the boron particles evaporating the diluent to form the resultant coated boron particles.

Accordingly, the primary object of this invention is to provide an improved composite solid propellant composition.

Another object of this invention is to provide a method for improving the burning characteristics of composite propellant compositions that utilize boron metal particles and ammonium perchlorate.

Still another object of this invention is to provide ammonium perchlorate coated boron metal particles for use in propellant compositions as a combination fuel and oxidizer component.

A further object of this invention is to provide a method for coating boron particles with ammmonium perchlorate.

The above and still further objects and advantages of the present invention will become more readily apparent upon consideration of the following detailed description of the preferred embodiment thereof.

DESCRIPTION OF THE PREFERRED EMBODIMENT

The foregoing objects of the present invention are accomplished by providing ammonium perchlorate coated boron particles. These particles have a particular application for use in composite solid propellants as a combination fuel and oxidizer. The boron metal particles supplement the conventional plastic binder fuel present in a composite propellant and, when used in combination with the ammonium perchlorate oxidizer, provide a propellant with improved burning characteristics.

The reduced total surface area of the ammonium perchlorate coated boron, as compared with the use of separate particles of boron and ammonium perchlorate reduces the total surface area of the solids incorporated into the propellant binder. This makes possible increased solids loading and improves processability of the propellant. The intimate juxtaposition of the boron and ammonium perchlorate also raises the pressure exponent of the propellant as compared with separate loading of the boron ammonium perchlorate components. This property is advantageous for certain applications, such as inflight controllability of the burning rate of the propellant.

In general, the process for making the ammonium perchlorate coated boron comprises the following steps. The first step involves dissolving the ammonium perchlorate preferably to its maximum solubility, in anhydrous liquid ammonia. This is followed by the step of adding a volatile, non-solvent diluent and the finely-divided boron. The next step involves evaporating the ammonia, preferably with continued stirring and preferably under vacuum to increase the vaporization rate.

The final step involves evaporating the volatile non-solvent diluent to form a finely-divided granular ammonium perchloride coated boron product.

the diluent must be a non-solvent for the ammonium perchlorate but miscible with the anhydrous ammonia so as to form a single liquid phase. An example of a suitable diluent is ethylacetate. Although the diluent should be volatile to provide for stripping, it must be less volatile than the anhydrous ammonia.

The anhydrous ammonia has advantages of substantial ammonium perchlorate solubility, very high volatility, and freedom from contamination of the ammonium perchlorate.

The relative amounts of anhydrous ammonia, ethylacetate, and ammonium perchlorate are not critical. The ammonium perchlorate concentration will, of course, largely be determined by the relative ammonium perchlorate boron ratios desired.

The production of coated boron particles from boron slurries in a solution of ammonium perchlorate and anhydrous ammonia, though resulting in coated particles, has the disadvantage of resulting in caking.

The following example is presented to illustrate a specific embodiment of the invention, however, since the example is illustrative only it is not to be construed as limiting the invention in any way.

EXAMPLE 120 grams of ammonium perchlorate were added to 200 ml of anhydrous liquid ammonia in a mixer bowl. The mixture was stirred until all of the ammonium perchlorate was dissolved. 50 ml ethylacetate were added and then 80 grams of finely-divided boron. Mixing was continued under vacuum. The ammonia vaporized first and then the ethylacetate. After two hours, the resulting ammonium perchlorate coated boron was substantially dry and granular. The product was put in a vacuum oven for 2 hours at 160°F to complete drying.

This invention is applicable to any of the composites type solid propellants using boron particles as a supplemental fuel and ammonium perchlorate as the oxidizer component. For example, Table I sets forth a specific example of this type of solid propellant and is illustrative of the type of propellants that can utilize the ammonium perchlorate coated boron particles of the invention

TABLE I

| Composition | Percent by weight |
|---|---|
| Ammonium perchlorate | 42 |
| Boron Particles | 29 |
| Plastic Binder | 29 |
| Additives | 0 |

The propellant exemplified in Table I was compounded in a conventional manner. The various ingredients were thoroughly incorporated by mixing so that a composition is obtained wherein the binder forms the continuous phase. The boron particles are first coated in accordance with this invention and then added to the binder prior to mixing.

While the invention has been described with particular reference to a specific embodiment, it is to be clearly understood that the present disclosure has been made only by way of illustration and that numerous modifications and alterations may be resorted to without departing from the spirit of the invention, the scope of which is defined by the appended claims.

What is claimed is:

1. A method for providing boron particles with a coating of ammonium perchlorate which comprises the steps of:

a. dissolving ammonium perchlorate in anhydrous liquid ammonia;

b. adding a volatile diluent and finely-divided boron to said ammonia said diluent being miscible with said liquid ammonia but a non-solvent for ammonium perchlorate;

c. evaporating said ammonia and said diluent under vacuum to form a finely-divided granular ammonium perchlorate coated boron.

2. A method in accordance with claim 1 wherein said diluent is ethylacetate.

* * * * *